US010107305B2

(12) United States Patent
Park

(10) Patent No.: US 10,107,305 B2
(45) Date of Patent: Oct. 23, 2018

(54) AIR-COOLING SYSTEM FOR FLUIDIC MACHINE

(71) Applicant: Hanwha Techwin Co., Ltd., Changwon-si (KR)

(72) Inventor: Ho Youl Park, Changwon-si (KR)

(73) Assignee: Hanwha Power Systems Co., Ltd., Changwon-si (KR)

( * ) Notice: Subject to any disclaimer, the term of this patent is extended or adjusted under 35 U.S.C. 154(b) by 0 days.

(21) Appl. No.: 15/610,902

(22) Filed: Jun. 1, 2017

(65) Prior Publication Data

US 2018/0017082 A1 Jan. 18, 2018

(30) Foreign Application Priority Data

Jul. 15, 2016 (KR) ..... 10-2016-0090261

(51) Int. Cl.
*F04D 29/58* (2006.01)
*F01P 5/02* (2006.01)

(52) U.S. Cl.
CPC ..... *F04D 29/5826* (2013.01)

(58) Field of Classification Search
CPC ..... F01P 1/06; F01P 5/02; F01P 5/025; F01P 2003/187; F04D 29/5826; F04D 27/005; F04D 29/5833; F04D 17/12; F02B 29/0475; F02B 29/0412; F28F 9/001; F28F 2009/004; F04B 39/16
See application file for complete search history.

(56) References Cited

U.S. PATENT DOCUMENTS 5,386,873 A * 2/1995 Harden, III ..... B60K 11/04 165/140
6,604,911 B2 * 8/2003 Pauwels ..... F04B 39/06 165/299
8,221,094 B2 * 7/2012 Nishimura ..... F01C 21/007 417/243
9,879,827 B2 * 1/2018 Hwang ..... F17C 7/04
2010/0303658 A1 * 12/2010 Ito ..... F01C 21/007 418/9
2011/0088637 A1 * 4/2011 Hirasawa ..... B60K 11/04 123/41.31
2013/0098088 A1 4/2013 Lin et al.
2014/0105734 A1 4/2014 Kato et al.
2017/0074268 A1 * 3/2017 De Kerpel ..... F04C 29/04

FOREIGN PATENT DOCUMENTS

JP 8-200271 A 8/1996
JP 5672171 B2 2/2015

* cited by examiner

*Primary Examiner* — Tho V Duong
(74) *Attorney, Agent, or Firm* — Sughrue Mion, PLLC

(57) ABSTRACT

An air-cooling system for fluidic machine includes a base frame, a first intercooler arranged above the base frame and in which a fluid for heat exchange flows, an oil cooler arranged adjacent to the first intercooler and in which oil flows, a second intercooler arranged above the base frame to face one of the first intercooler and the oil cooler and in which the fluid for heat exchange flows, an aftercooler arranged adjacent to the second intercooler to face the other of the first intercooler and the oil cooler and in which the fluid for heat exchange flows, and a blower supplying cooling air to a space between the first intercooler and the oil cooler, and the second intercooler and the aftercooler.

20 Claims, 7 Drawing Sheets

AIR-COOLING SYSTEM FOR FLUIDIC MACHINE

CROSS-REFERENCE TO THE RELATED APPLICATION

This application claims priority from Korean Patent Application No. 10-2016-0090261, filed on Jul. 15, 2016, in the Korean Intellectual Property Office, the disclosure of which is incorporated herein in its entirety by reference.

BACKGROUND

1. Field

One or more exemplary embodiments relate to an air-cooling system for fluidic machine, and more particularly, to an air-cooling system for fluidic machine, in which coolers are arranged to face each other, forming a space for cooling, so that cooling performance and scalability may be improved.

2. Description of the Related Art

In general, an air-cooling system may include a heat exchanger for heat exchange between a high temperature process gas, that is, a high-temperature and high-pressure compressed air, and a low temperature cooling gas, that is, surrounding atmosphere and a fan/motor driver for supplying surrounding air to the heat exchanger.

A turbo compressor, as a typical energy apparatus, has compression stages of a first stage, a second stage, and a third stage. In each compression stage, the temperature of a process gas increases as the process gas is compressed to a high pressure. Accordingly, a step for cooling the process gas in between the compression stages, and a step for cooling oil used in the turbo compressor, are required. The turbo compressor requires a cooling system for handling at least four cooling stages. There is a need for a cooling system technology that enables excellent cooling performance while enabling compact layout design and easy maintenance and repair.

To realize cooling at the four stages, a layout structure of stacking a plurality of heat exchangers in a box type arrangement is used to increase cooling efficiency. However, such a box-type layout structure may present an obstacle to scalability of a compressor for increasing the number of stages of the compressor. In other words, in order to scale up a compressor, new heat exchangers must be manufactured and assembled by disassembling all the heat exchangers stacked in a box type arrangement, and thus, scalability of the compressor and the cooling system is lowered.

Furthermore, when the box type layout structure of stacking a plurality of heat exchangers is used, only one blower is installed due to limited space. Accordingly, when a motor of the blower has trouble, the entire cooling system malfunctions. Also, it is difficult to effectively deal with the case of increasing capacity of the heat exchanger. For example, to cope with an increased capacity of the heat exchanger, an operating speed of the blower might simply be increased, but this results in increased operating noise of the blower as well.

Furthermore, in the box type layout structure of stacking a plurality of heat exchangers, maintenance and repair of a motor arranged in a box-shaped space is inconvenient and, when the blower or the motor goes out of order, it is practically impossible to access the blower or motor to replace a corresponding part of the blower or motor. In order to replace or repair the part, pipes of the heat exchanger need to be disassembled and a structure for supporting the heat exchanger needs to be entirely disassembled and thus work itself is very complicated and time consuming.

SUMMARY

One or more exemplary embodiments include an air-cooling system for fluidic machine, which may expand heat exchange capacity of the fluidic machine corresponding to an increase in the number of compression stages, thereby improving scalability of the fluidic machine.

One or more exemplary embodiments include an air-cooling system for fluidic machine, which has excellent cooling performance and is easy to maintain and repair.

One or more exemplary embodiments include an air-cooling system for fluidic machine, which may reduce generation of noise in a blower.

Additional aspects will be set forth in part in the description which follows and, in part, will be apparent from the description, or may be learned by practice of the presented exemplary embodiments.

According to one or more exemplary embodiments, an air-cooling system for fluidic machine includes a base frame, a first intercooler arranged above the base frame and in which a fluid for heat exchange flows, an oil cooler arranged adjacent to the first intercooler and in which oil flows, a second intercooler arranged above the base frame to face one of the first intercooler and the oil cooler and in which the fluid for heat exchange flows, an aftercooler arranged adjacent to the second cooler to face the other of the first intercooler and the oil cooler and in which the fluid for heat exchange flows, and a blower supplying cooling air to a space between the first intercooler and the oil cooler, and the second intercooler and the aftercooler.

The oil cooler may be arranged above the base frame and adjacent to one edge of the first intercooler successively in an extension direction of the first intercooler, and the aftercooler may be arranged above the base frame and adjacent to one edge of the second intercooler successively in an extension direction of the second intercooler.

The first intercooler and the oil cooler, and the aftercooler and the second intercooler, may be arranged inclined relative to the base frame to be spaced farther apart from each other toward an upper side from the base frame.

Each of the first intercooler and the oil cooler may have a rectangular parallelepiped shape, and the oil cooler may be arranged successively after the first intercooler in a direction in which a largest surface of the first intercooler extends, wherein a direction in which a largest surface of the oil cooler extends is the same as or parallel to the direction in which the largest surface of the first intercooler extends.

Each of the second intercooler and the aftercooler may have a rectangular parallelepiped shape, and the aftercooler may be arranged successively after the second intercooler in a direction in which a largest surface of the second intercooler extends, wherein a direction in which a largest surface of the aftercooler extends is the same as or parallel to the direction in which the largest surface of the second intercooler extends.

The air-cooling system may further include a bracket coupling a lower end of one of the first intercooler and the oil cooler or one of the second intercooler and the aftercooler to the base frame, and a through bracket coupling a lower end of the other one of the first intercooler and the oil cooler or the other one of the second intercooler and the aftercooler, to the base frame to be vertically spaced apart from the base frame.

A transfer pipe connected to the other one of the first intercooler and the oil cooler or the other one of the second intercooler and the aftercooler may pass through the through bracket.

The oil cooler may be arranged above the first intercooler to be adjacent to an upper end of the first intercooler opposite to the lower end facing the base frame, and the second intercooler and the aftercooler may be successively stacked above the base frame to face the first intercooler and the oil cooler.

The oil cooler arranged above the first intercooler may be manufactured to have a size smaller than a size of the first intercooler, and the second intercooler stacked above the aftercooler may be manufactured to have a size smaller than a size of the aftercooler.

The air-cooling system may further include a bracket connecting each of a lower end of the first intercooler facing the base frame and a lower end of the second intercooler facing the base frame, to the base frame, and a connection bracket connecting the first intercooler to the oil cooler, and connecting the aftercooler to the second intercooler.

The first intercooler and the oil cooler, and the aftercooler and the second intercooler, may be arranged inclined relative to the base frame to be spaced farther apart from each other toward an upper side from the base frame.

An inclination angle at which the first intercooler and the oil cooler are inclined relative to the base frame may be the same as an inclination angle at which the aftercooler and the second intercooler are inclined to the base frame.

The air-cooling system may further include an air/water separator connected to at least one of the first intercooler, the second intercooler, and the aftercooler, the air/water separator separating condensate included in compressed air.

The air-cooling system may further include a door arranged on a path that connects a cooling space formed by the first intercooler and the oil cooler, and the second intercooler and the aftercooler, to the outside.

The air-cooling system may further include a partition surrounded by the first intercooler, the oil cooler, the second intercooler, the aftercooler, and the cooling space, the partition comprising a blow hole in which the blower is provided and an air circulation hole that connects the cooling space to the outside, wherein the door is rotatably coupled to the partition to open or close at least a part of the partition.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
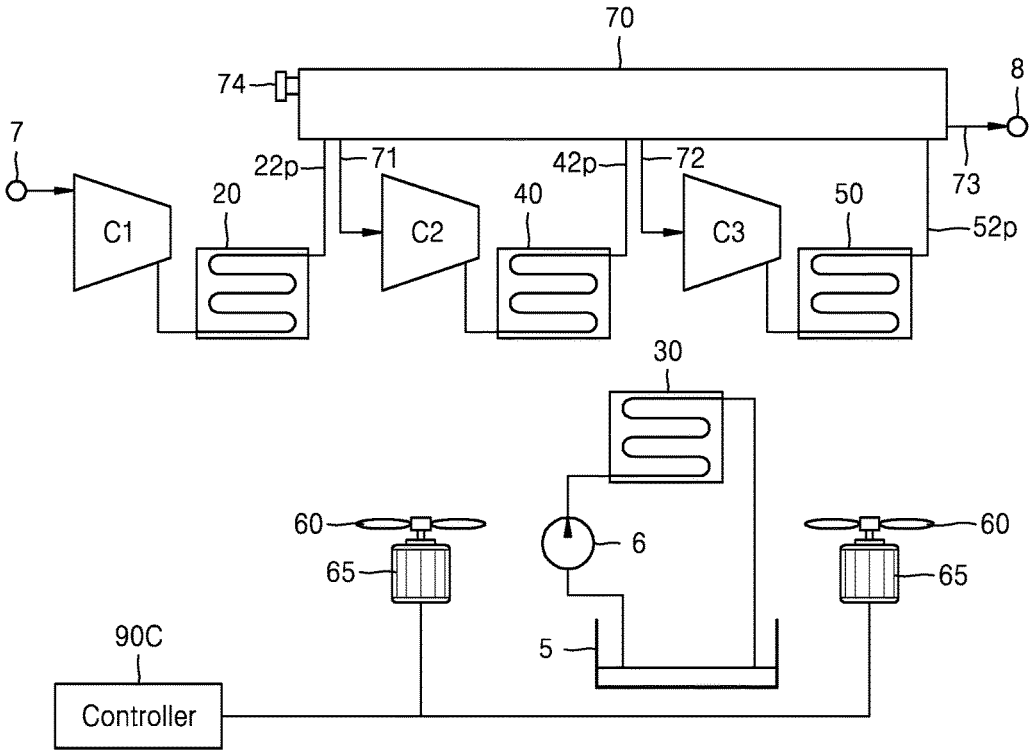
FIG. 1 is a circuit diagram schematically showing a connection relationship of elements of an air-cooling system for fluidic machine according to an embodiment.

Reference will now be made in detail to the structure and operation of an air-cooling system for fluidic machine, examples of which are illustrated in the accompanying drawings, wherein like reference numerals refer to like elements throughout. In this regard, the present embodiments may have different forms and should not be construed as being limited to the exemplary descriptions set forth herein. Accordingly, the exemplary embodiments are merely described below, by referring to the figures, to explain aspects of the present disclosure. As used herein, expressions such as "at least one of," when preceding a list of elements, modify the entire list of elements and do not modify the individual elements of the list.

FIG. 1 is a circuit diagram schematically showing a connection relationship of elements of an air-cooling system for fluidic machine according to an exemplary embodiment.

The air-cooling system for fluidic machine according to the embodiment of FIG. 1 is an example of fluidic machine, in which an air-cooling system is applied to a turbo compressor. The turbo compressor may include three compressors C1-C3 of a first stage compressor C1, a second stage compressor C2, and a third stage compressor C3. The compressors C1-C3 are successively and serially connected to one another and each of the compressors C1-C3 compresses a fluid such as air at high pressure and discharges a compressed fluid. The fluid may also be a refrigerant, or the like.

When a fluid is supplied to the first stage compressor C1 through an inlet 7 connected to the first stage compressor C1, the first stage compressor C1 compresses the fluid and discharges a compressed fluid. Since the fluid discharged from the first stage compressor C1 is in a high-temperature and high-pressure state, the fluid is cooled by passing through a first intercooler 20.

The fluid cooled by and discharged from the first intercooler 20 is transferred to an air/water separator 70, where moisture is removed from the fluid, via a transfer pipe 22*p*. Then, the fluid is supplied to the second stage compressor C2 via a first discharge pipe 71 of the air/water separator 70.

When the fluid is supplied to the second stage compressor C2, the second stage compressor C2 compresses and discharges the fluid. The fluid discharged from the second stage compressor C2 is also in a high-temperature and high-pressure state, and thus, the fluid is cooled while passing through a second intercooler 40.

The fluid cooled by and discharged from the second intercooler 40 is transferred to the air/water separator 70, where moisture is removed from the fluid, via a transfer pipe 42*p*. Then, the fluid is supplied to the third stage compressor C3 via a second discharge pipe 72 of the air/water separator 70.

When the fluid is supplied to the third stage compressor C3, the third stage compressor C3 compresses and discharges the fluid. Since the fluid discharged from the third stage compressor C3 is also in a high-temperature and high-pressure state, the fluid is cooled while passing through an aftercooler 50.

The fluid cooled by and discharged from the aftercooler 50 is transferred to the air/water separator 70, where moisture is removed from the fluid, via a transfer pipe 52*p*, and discharged to a discharge portion 8 via a third discharge pipe 73 of the air/water separator 70.

In the fluidic machine including the compressors C1-C3, oil is supplied to drive various actuators. The oil in a reservoir 5 is supplied to various parts of the fluidic machine by a pump 6. As the oil is used, the temperature of oil increases and thus a cooling operation of the oil is performed by an oil cooler 30.

The fluid for heat exchange discharged from the compressors C1-C3 flows in the first intercooler 20, the second intercooler 40, and the aftercooler 50. The first intercooler 20, the second intercooler 40, and the aftercooler 50 are air-cooling systems that cool the fluid flowing inside by contacting another fluid for cooling, such as external air supplied from a blower 60.

The oil cooler 30 is an air-cooling system, in which oil for heat exchange flows. The oil cooler 30 also cools the oil flowing inside by contacting the cooling air supplied from the blower 60.

The blower 60 is driven by a motor 65. As a controller 90C applies a control signal to the motor 65, the operation and stopping of the blower 60 may be controlled and a rotation speed of the blower 60 may also be controlled.

Figure 2:
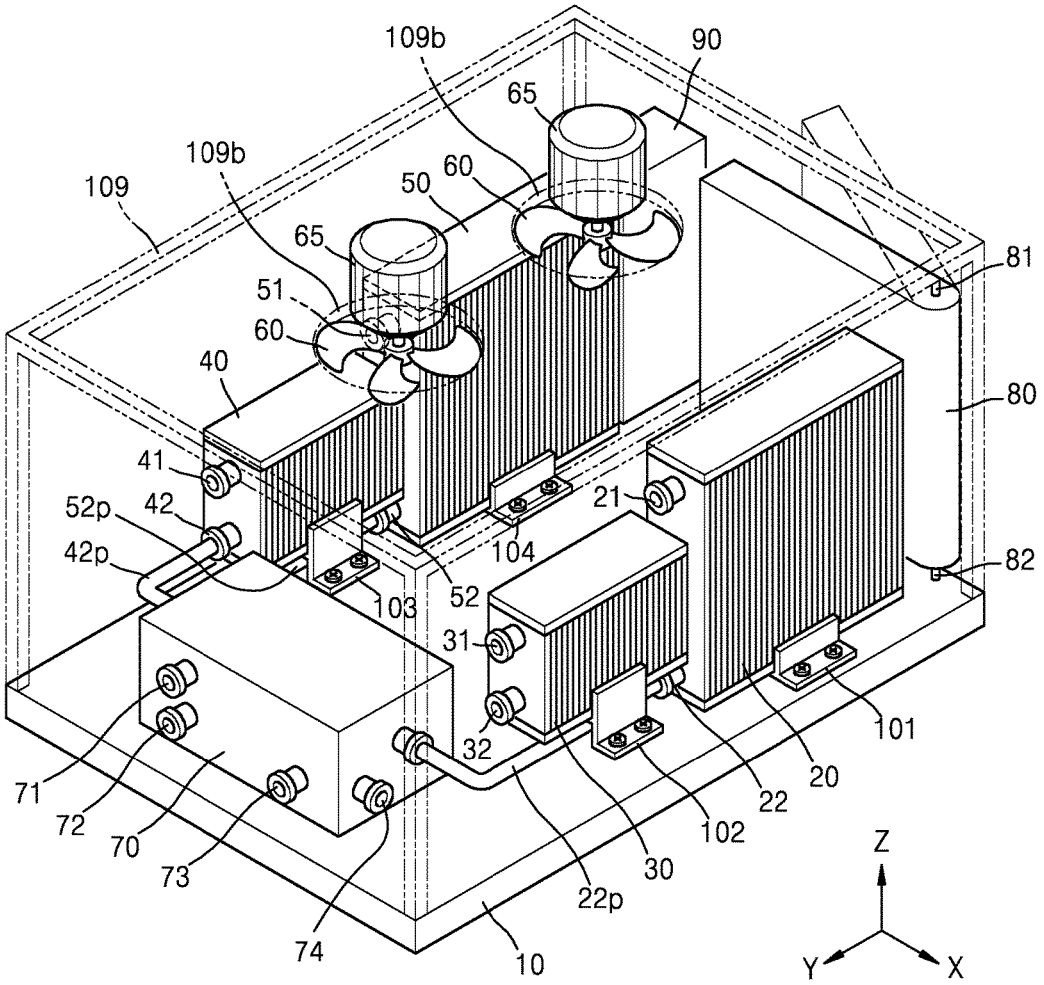
FIG. 2 is a perspective view of the air-cooling system for fluidic machine of FIG. 1.
Figure 3:
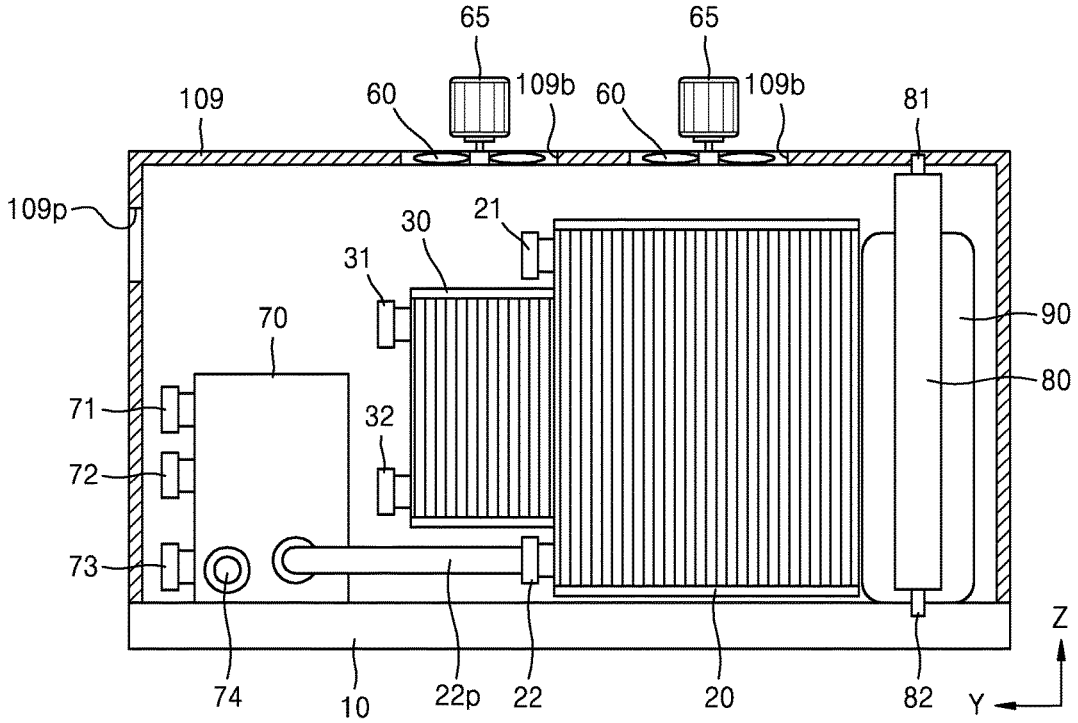
FIG. 3 is a right side view of the air-cooling system for fluidic machine of FIG. 2.
Figure 4:
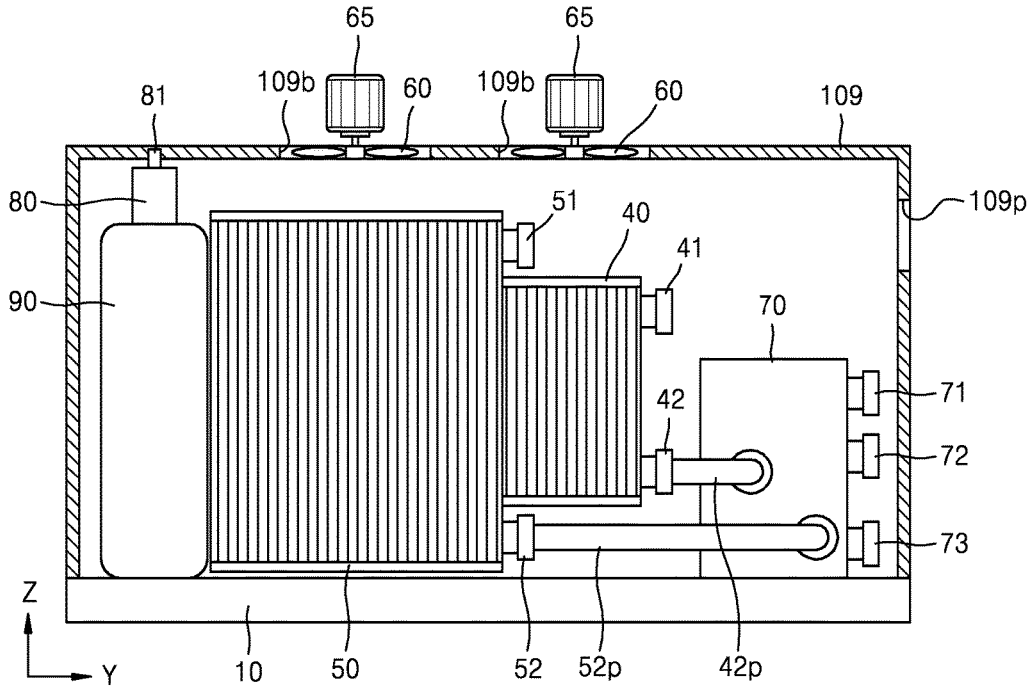
FIG. 4 is a left side view of the air-cooling system for fluidic machine of FIG. 2.

FIG. 2 is a perspective view of the air-cooling system for fluidic machine of FIG. 1. FIG. 3 is a right side view of the air-cooling system for fluidic machine of FIG. 2. FIG. 4 is a left side view of the air-cooling system for fluidic machine of FIG. 2.

FIGS. 2 to 4 illustrate a layout relationship of the elements of the air-cooling system used for fluidic machine of FIG. 1.

The air-cooling system may include a base frame 10, the first intercooler 20 arranged above the base frame 10, in which a fluid for heat exchange flows, the oil cooler 30 arranged adjacent to the first intercooler 20, in which oil flows, the second intercooler 40 arranged above the base frame 10 facing the oil cooler 30, in which the fluid for heat exchange flows, the aftercooler 50 arranged facing the oil cooler 30 and adjacent to the second intercooler 40, in which the fluid for heat exchange flows, and the blower 60 for supplying cooling air to a space between the first intercooler 20/the oil cooler 30, and the second intercooler 40/the aftercooler 50, facing each other.

A lower end portion of each of the first intercooler 20 and the aftercooler 50 is coupled to the base frame 10 by means of brackets 101 and 104, respectively. Furthermore, the second intercooler 40 and the oil cooler 30 are manufactured to be vertically lower than the heights of the first intercooler 20 and the aftercooler 50, and a lower end portion of each of the second intercooler 40 and the oil cooler 30 is coupled to the base frame 10 to be vertically spaced apart from the base frame 10 in a Z-axis direction by means of through brackets 102 and 103, respectively.

The first intercooler 20 has a substantially rectangular parallelepiped shape. The first intercooler 20 may include an inlet 21, through which compressed air that is the fluid discharged from the first stage compressor C1 of FIG. 1 enters, and an outlet 22 through which cooled compressed air is discharged. The outlet 22 of the first intercooler 20 is connected to the air/water separator 70. The transfer pipe 22*p* passes through the through bracket 102 supporting the oil cooler 30 and is connected to the air/water separator 70. When the compressed air discharged from the first intercooler 20 passes through the air/water separator 70, condensate included in the compressed air is removed, and then the compressed air is discharged from the first discharge pipe 71.

The second intercooler 40 has a substantially rectangular parallelepiped shape. The second intercooler 40 may include an inlet 41, through which compressed air that is the fluid discharged from the second stage compressor C2 of FIG. 1 enters, and an outlet 42 through which cooled compressed air is discharged. The outlet 42 of the second intercooler 40 is connected to the air/water separator 70 via the transfer pipe 42*p*. When the compressed air discharged from the second intercooler 40 passes through the air/water separator 70, the condensate included in the compressed air is removed, and then the compressed air is discharged from the second discharge pipe 72.

The aftercooler 50 has a substantially rectangular parallelepiped shape. The aftercooler 50 may include an inlet 51, through which compressed air that is the fluid discharged from the third stage compressor C3 of FIG. 1 enters, and an outlet 52 through which cooled compressed air is discharged. The transfer pipe 22*p* passes through the through bracket 103 supporting the oil cooler 30 and is connected to the air/water separator 70. When the compressed air discharged from the aftercooler 50 passes through the air/water separator 70, the condensate included in the compressed air is removed, and then the compressed air is discharged from the third discharge pipe 73.

The air/water separator 70 may include a drainpipe 74 through which the condensate extracted from the compressed air is discharged.

Although in the present exemplary embodiment the first intercooler 20 and the aftercooler 50 are arranged to face each other and the second intercooler 40 and the oil cooler 30 are arranged to face each other, the present disclosure is not limited to the above layout relationship. Accordingly, the first intercooler 20 and the second intercooler 40 may be arranged to face each other and the oil cooler 30 and the aftercooler 50 may be arranged to face each other. A space is defined between where the first intercooler 20 and the oil cooler 30 are located, and where the second intercooler 40 and the aftercooler 50 are located.

The oil cooler 30 has a substantially rectangular parallelepiped shape. The oil cooler 30 is arranged above the base frame 10 and adjacent to one side of the first intercooler 20 successively in an extension direction of the first intercooler 20 (Y-axis direction). The extension direction (Y-axis direction) of the first intercooler 20 denotes a direction in which the largest surface of the first intercooler 20 having a rectangular parallelepiped shape extends. Accordingly, a direction in which the largest surface of the cooler 30 having a rectangular parallelepiped shape extends is the same as or parallel to the extension direction of the first intercooler 20. That is, the oil cooler 30 and the first intercooler 20 are aligned side-by-side in the extension direction of the first intercooler 20, which is an elongated direction of the first intercooler 20, for example a length direction of the first intercooler 20.

Furthermore, the aftercooler 50 is arranged above the base frame 10 and adjacent to one side of the second intercooler 40 successively in the extension direction (Y-axis direction) of the second intercooler 40. The extension direction (Y-axis direction) of the second intercooler 40 denotes a direction in which the largest surface of the second intercooler 40 having a rectangular parallelepiped shape extends. Accordingly, a direction in which the largest surface of the aftercooler 50 having a rectangular parallelepiped shape extends is the same as or parallel to the extension direction of the second intercooler 40. That is, the aftercooler 50 and the second intercooler 40 are aligned side-by-side in the extension direction of the first intercooler 40, which is an elongated direction of the second intercooler 40, for example a length direction of the second intercooler 40.

The air/water separator 70 is connected to at least one of the first intercooler 20, the second intercooler 40, and the aftercooler 50, and separates the condensate included in the compressed air, that is, the fluid compressed by the first intercooler 20, the second intercooler 40, and the aftercooler 50. The air/water separator 70 is provided above the base frame 10.

A partition 109 surrounding all elements including the first intercooler 20, the oil cooler 30, the second intercooler 40, the aftercooler 50, and the air/water separator 70, is provided on the base frame 10. As the partition 109 surrounds the first intercooler 20, the oil cooler 30, the second intercooler 40, the aftercooler 50, and a cooling space between the elements facing each other, a flow of cooling air formed by the blower 60 stays in the cooling space defined by the partition 109 by being shielded from an external environment, thereby implementing an environment for achieving a sufficient cooling effect.

The blower 60 driven by the motor 65 is provided in a blow hole 109*b* formed in an upper side of the partition 109. Although in the drawings two motors of the motor 65 and the blower 60 are provided, only one motor may be provided and the number of the motors and the blowers may be increased according to the size of a space to be cooled.

An air circulation hole 109*p* connecting the inner space of the partition 109 and the outside may be provided at a predetermined position in the partition 109 (see FIGS. 3 and 4). Of the partition 109, the air circulation hole 109*p* may be formed in a side wall facing the first intercooler 20 and the oil cooler 30, and in a side wall facing the second intercooler 40 and the aftercooler 50.

The blower 60 is driven by the motor 65 to supply the cooling air to a space between the first intercooler 20/ the oil cooler 30, and the second intercooler 40/the aftercooler 50, facing each other.

According to the air-cooling system for fluidic machine configured as above, as the blower 60 supplies the cooling air to the space between the first intercooler 20/the oil cooler 30, and the second intercooler 40/the aftercooler 50, facing each other, the fluids flowing in the first intercooler 20, the oil cooler 30, the second intercooler 40, and the aftercooler 50, may be effectively cooled.

Furthermore, by using a structure in which coolers are arranged to face each other and a space between the coolers facing each other is used as a path for cooling air, more coolers that are needed as the number of compression stages increases may be arranged to face each other so as to effectively cope with the increase in the number of compression stages.

In a case in which the number of compression stages increase as a cooling system undergoes design and manufacture, according to a related art, it was impossible to add necessary coolers corresponding to the increased number of compression stages. Since existing heat exchangers must all be disassembled, and then newly designed heat exchangers are manufactured to increase the number of coolers in a cooling system that is already manufactured, it is actually impossible to cope with the increase in the number of compression stages.

However, in the air-cooling system for fluidic machine according to the above-described exemplary embodiment, new coolers may be added successively in a direction in which the first intercooler 20 and the oil cooler 30 are arranged, and new coolers may be added successively in a direction in which the second intercooler 40 and the aftercooler 50 are arranged facing the first intercooler 20 and the oil cooler 30. Thus, heat capacity of the air-cooling system for fluidic machine may be easily increased to cope with the increase in the number of compression stages.

Furthermore, since additional ones of the blower 60 and the motor 65 may be added corresponding to the added coolers, unlike the related art, the operating speed of the blower 60 does not need to be excessively increased to cope with the increased heat capacity of the heat exchanger. Accordingly, generation of operating noise of the blower 60 of the air-cooling system for fluidic machine may be reduced.

A control box 90 including the controller 90C (see FIG. 1) for controlling the motor 65 by applying an electrical signal to the motor 65 and a power supply unit for supplying electric power to the motor 65 is provided at the back of the aftercooler 50. Furthermore, a door 80 is provided on a path in which the space between the aftercooler 50 and the first intercooler 20 facing each other is connected to the outside through the partition 109. The door 80 is rotatably arranged by means of hinges 81 and 82 with respect to the base frame 10 and the partition 109.

When the air-cooling system for fluidic machine is in operation, by closing the door 80, the space between the first intercooler 20/the oil cooler 30, and the second intercooler 40/the aftercooler 50, facing each other, is shielded from the outside so that excellent cooling performance may be obtained.

When the state or operation status of the first intercooler 20, the oil cooler 30, second intercooler 40, the aftercooler 50, the blower 60, and the motor 65 is abnormal, or when various pipes are inspected or some parts are out of order, by opening the door 80, an operator may easily access the space between the first intercooler 20/the oil cooler 30, and the second intercooler 40/the aftercooler 50, facing each other, through the door 80 that is open.

According to the related art, when some parts are out of order, an intercooler and other components such as pipes connected to the intercooler need to be inconveniently disassembled for repair. However, in the air-cooling system for fluidic machine according to the above-described embodiment, maintenance and repair may be conveniently performed through the door 80.

Figure 5:
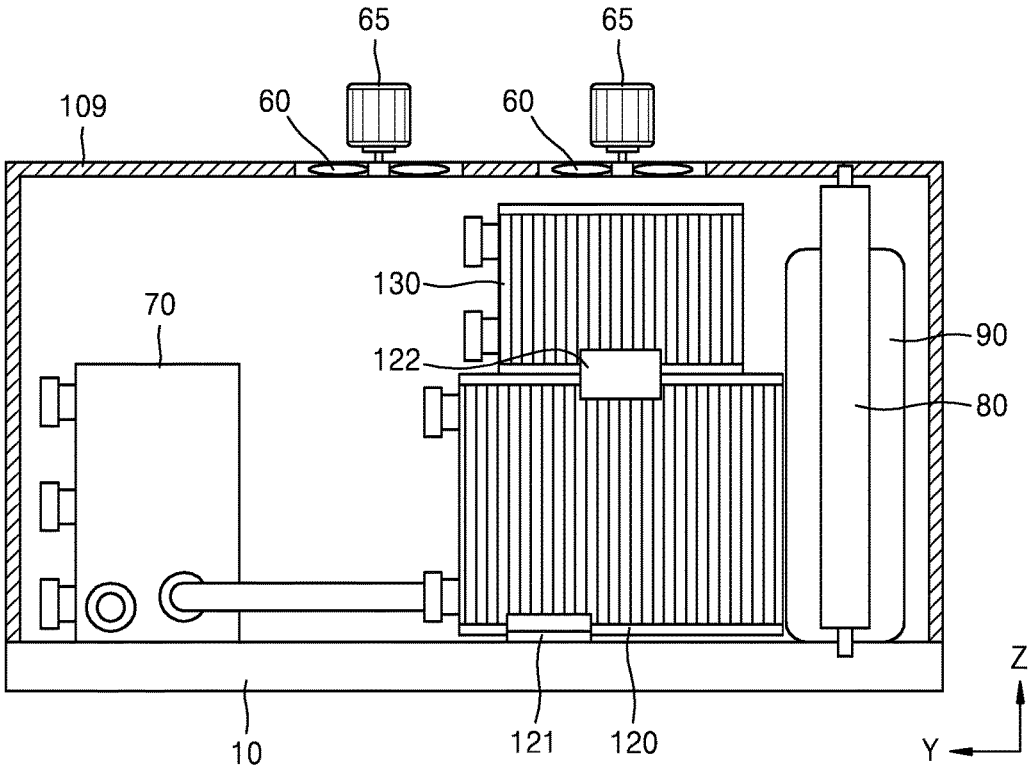
FIG. 5 is a side view of an air-cooling system for fluidic machine according to another exemplary embodiment.

FIG. 5 is a side view of an air-cooling system for fluidic machine according to another exemplary embodiment. In FIG. 5, like reference numerals are used for like elements of the air-cooling system for fluidic machine of FIGS. 2 to 4.

In the air-cooling system for fluidic machine according to the exemplary embodiment of FIG. 5, a first intercooler 120 is arranged above the base frame 10, and an oil cooler 130 is arranged above the first intercooler 120 to be adjacent to an upper end of the first intercooler 120 that is opposite to a lower end thereof facing the base frame 10.

The lower end of the first intercooler 120 abutting the base frame 10 is coupled to the base frame 10 by means of a bracket 121. The upper end of the first intercooler 120 and a lower end of the oil cooler 130 are coupled to each other by means of a connection bracket 122.

Furthermore, although not illustrated in FIG. 5, an aftercooler is arranged above the base frame 10 at a position facing the first intercooler 120, and a second intercooler is arranged above the aftercooler adjacent to an upper end of the aftercooler that is opposite to a lower end of the aftercooler facing the base frame 10. The lower end of the aftercooler is coupled to the base frame 10 by means of a bracket, and the upper end of the aftercooler and the lower end of the second intercooler are coupled to each other by means of a connection bracket. Alternatively, by modifying the above layout structure, the second intercooler may be arranged closer to the base frame 10 than the aftercooler, and the aftercooler may be arranged above the second intercooler.

To make the layout structure stable, the oil cooler 130 arranged above the first intercooler 120 may be manufactured to be smaller than that size of the first intercooler 120, the second intercooler arranged above the aftercooler may be manufactured to be smaller than the size of the aftercooler.

The partition 109 is provided on the base frame 10 and surrounds all elements including the first intercooler 120, the oil cooler 130, second intercooler, the aftercooler, and the air/water separator 70. The blower 60 driven by the motor 65 is provided on the top side of the partition 109.

According to the air-cooling system for fluidic machine configured as above, as the blower 60 supplies cooling air to a space between the first intercooler 120/the oil cooler 130, and the second intercooler/the aftercooler, facing each other, the fluids flowing in the first intercooler 120, the oil cooler 130, the second intercooler, and the aftercooler may be effectively cooled.

Figure 6:
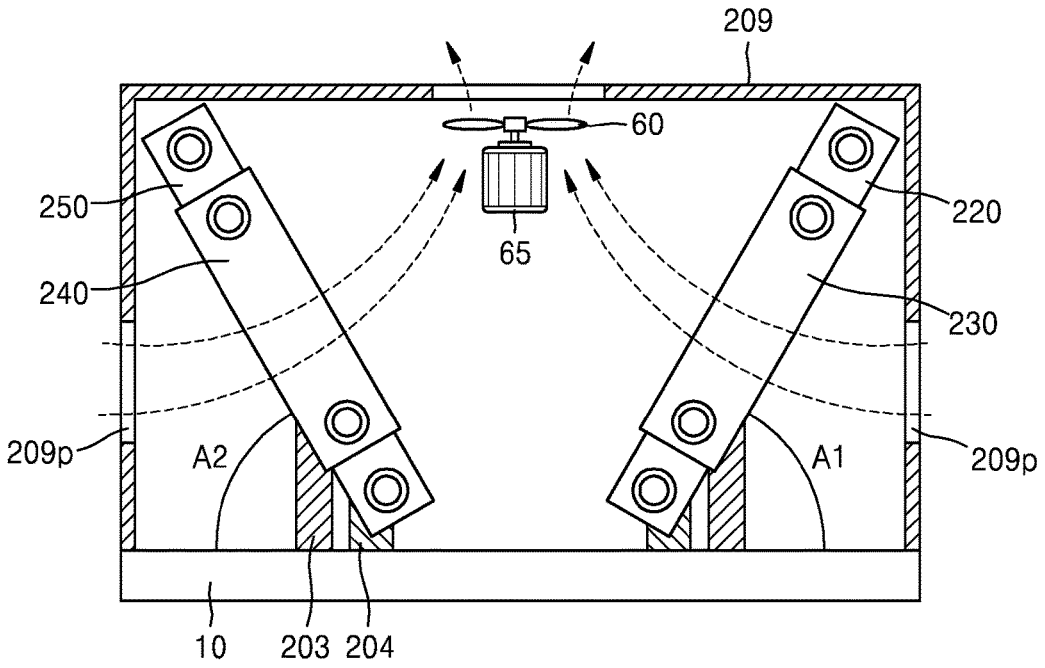
FIG. 6 is a front side view of an air-cooling system for fluidic machine according to another exemplary embodiment.

FIG. 6 is a front side view of an air-cooling system for fluidic machine according to another exemplary embodiment.

In the air-cooling system for fluidic machine according to the exemplary embodiment of FIG. 6, an oil cooler 230 and a first intercooler 220 successively arranged in a direction in which the base frame 10 extends are arranged inclined relative to the base frame 10 by a first inclination angle A1.

Furthermore, a second intercooler 240 and an aftercooler 250 successively arranged in the direction in which the base frame 10 extends are arranged inclined relative to the base frame 10 by a second inclination angle A2.

The first inclination angle A1 by which the oil cooler 230 and the first intercooler 220 are inclined relative to the base frame 10 and the second inclination angle A2 by which the second intercooler 240 and the aftercooler 250 are inclined relative to the base frame 10 may be set to be identical to each other. The inclination angles A1 and A2 are acute angles.

The oil cooler 230 and the first intercooler 220, and the second intercooler 240 and the aftercooler 250, are arranged to face each other and inclined relative to the base frame 10 such that the oil cooler 230 and the first intercooler 220, and the second intercooler 240 and the aftercooler 250, are spaced farther apart from each other from the base frame 10 toward the upper side. In other words, in FIG. 6, the oil cooler 230 and the first intercooler 220 are arranged with upper ends thereof inclined to the right, and the second intercooler 240 and the aftercooler 250 are arranged with upper ends thereof inclined to the left.

Accordingly, lower ends of the oil cooler 230 and the first intercooler 220, and lower ends of the second intercooler 240 and the aftercooler 250 are supported by brackets 203 and 204 such that the lower ends are located closer to each other than upper ends thereof.

According to the air-cooling system for fluidic machine configured as above, a space between the oil cooler 230/the first intercooler 220, and the second intercooler 240/the aftercooler 250, facing each other, is secured to be wider toward the upper side from the base frame 10. A partition 209 surrounds a cooling space between the oil cooler 230/the first intercooler 220, and the second intercooler 240/the aftercooler 250, facing each other. The partition 209 may include an air circulation hole 209*p* and a blow hole 209*b* connecting the cooling space to the outside.

When the blower 60 is operated, external air is introduced into the cooling space between the oil cooler 230/the first intercooler 220, and the second intercooler 240/the aftercooler 250, facing each other, through the air circulation hole 209*p* so that the fluids flowing in the oil cooler 230, the first intercooler 220, the second intercooler 240, and the aftercooler 250 may be effectively cooled. The air that performed the cooling operation is discharged to the outside of the partition 209 through the blow hole 209*b*.

Figure 7:
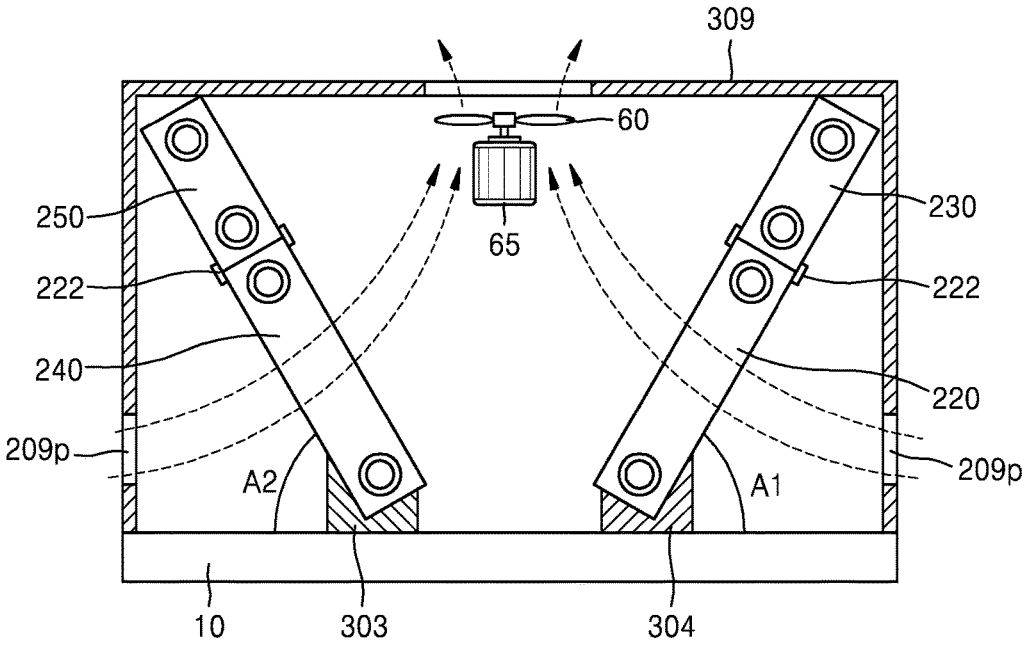
FIG. 7 is a front side view of an air-cooling system for fluidic machine according to another exemplary embodiment.

FIG. 7 is a front side view of an air-cooling system for fluidic machine according to another exemplary embodiment.

In the air-cooling system for fluidic machine according to the exemplary embodiment of FIG. 7, the first intercooler 220 supported by a bracket 304 is arranged inclined relative to the base frame 10 by a first inclination angle A1, and the oil cooler 230 located above the first intercooler 220 is arranged inclined relative to the base frame 10 by the same angle as the first inclination angle A1 in the same direction in which the first intercooler 220 is inclined. The upper end of the first intercooler 220 and the lower end of the oil cooler 230 are coupled to each other by means of a connection bracket 222. Furthermore, the second intercooler 240 supported by a bracket 303 is arranged inclined relative to the base frame 10 by a second inclination angle A2 at a position facing the first intercooler 220, and the aftercooler 250 located above the second intercooler 240 is arranged inclined relative to the base frame 10 by the same angle as the second inclination angle A2 in the same direction in which the second intercooler 240 is inclined. The upper end of the second intercooler 240 and the lower end of the aftercooler 250 are coupled to each other by means of the connection bracket 222.

The first inclination angle A1 of the oil cooler 230 and the first intercooler 220 to the base frame 10 and the second inclination angle A2 of the second intercooler 240 and the aftercooler 250 to the base frame 10 may be set to be the same.

According to the air-cooling system for fluidic machine configured as above, the space between the oil cooler 230/the first intercooler 220, and the second intercooler 240/the aftercooler 250, facing each other, is secured to be wider toward the upper side from the base frame 10. A partition 309 surrounds the cooling space between the oil cooler 230/the first intercooler 220, and the second intercooler 240/the aftercooler 250, facing each other. The partition 309 may include the air circulation hole 209*p* and the blow hole 209*b* connecting the cooling space to the outside.

When the blower 60 is operated, external air is introduced into the cooling space between the oil cooler 230/the first intercooler 220, and the second intercooler 240/the aftercooler 250, facing each other, through the air circulation hole 209*p* so that the fluids flowing in the oil cooler 230, the first intercooler 220, the second intercooler 240, and the aftercooler 250 may be effectively cooled. The air that performed the cooling operation is discharged to the outside of the partition 209 through the blow hole 209*b*.

As described above, in the air-cooling system for fluidic machine according to the above-described exemplary embodiments, as the blower supplies the cooling air into the cooling space between the first intercooler/the oil cooler, and the second intercooler/the aftercooler, facing each other, the fluids flowing in the first intercooler, the oil cooler, the second intercooler, and the aftercooler may be effectively cooled.

Furthermore, according to the structure in which the cooling space between the coolers arranged facing each other is used as a path for the cooling air, more coolers that are needed as the number of compression stages increases may be arranged to face each other so as to effectively cope with the increase in the number of compression stages. Accordingly, scalability of the fluidic machine may be improved.

When the states of the components are inspected or some parts are out of order, the operator may easily access the space between the first intercooler/the oil cooler, and the second intercooler/the aftercooler, facing each other, through the door that is open, thereby making maintenance and repair convenient. Furthermore, when the coolers are added or extended according to the increase in the capacity and the number of the compression stages, since the blower and the motor are added in the lengthwise direction of the cooling system, that is, in the direction parallel to the cooler, the operating speed of the blower does not need to be excessively increased to cope with the increased heat capacity of the heat exchanger. Accordingly, generation of operating noise of the blower of the air-cooling system for fluidic machine may be reduced.

It should be understood that embodiments described herein should be considered in a descriptive sense only and not for purposes of limitation. Descriptions of features or aspects within each exemplary embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. An air-cooling system for fluidic machine, the air-cooling system comprising:

a base frame;

a first intercooler arranged above the base frame, wherein a fluid for heat exchange flows in the first intercooler;

an oil cooler arranged adjacent to the first intercooler, wherein oil flows in the oil cooler;

a second intercooler arranged above the base frame, wherein the fluid for heat exchange flows in the second intercooler, and the second intercooler faces one of the first intercooler and the oil cooler;

an aftercooler arranged adjacent to the second intercooler, wherein the fluid for heat exchange flows in the aftercooler, and the aftercooler faces the other of the first intercooler and the oil cooler; and a blower configured to supply cooling air to a space between the first intercooler and the oil cooler, and the second intercooler and the aftercooler.

2. The air-cooling system for fluidic machine of claim 1, wherein the oil cooler is arranged above the base frame and adjacent to one edge of the first intercooler successively in an extension direction of the first intercooler, and wherein the aftercooler is arranged above the base frame and adjacent to one edge of the second intercooler successively in an extension direction of the second intercooler.

3. The air-cooling system for fluidic machine of claim 2, wherein the first intercooler and the oil cooler, and the aftercooler and the second intercooler are arranged inclined relative to the base frame to be spaced farther apart from each other toward an upper side above the base frame.

4. The air-cooling system for fluidic machine of claim 1, wherein each of the first intercooler and the oil cooler has a rectangular parallelepiped shape, wherein the oil cooler is arranged successively after the first intercooler in a direction in which a largest surface of the first intercooler extends, and wherein a direction in which a largest surface of the oil cooler extends is the same as or parallel to the direction in which the largest surface of the first intercooler extends.

5. The air-cooling system for fluidic machine of claim 4, wherein each of the second intercooler and the aftercooler has a rectangular parallelepiped shape, wherein the aftercooler is arranged successively after the second intercooler in a direction in which a largest surface of the second intercooler extends, and wherein a direction in which a largest surface of the aftercooler extends is the same as or parallel to the direction in which the largest surface of the second intercooler extends.

6. The air-cooling system for fluidic machine of claim 5, further comprising:

a bracket coupling a lower end of one of the first intercooler and the oil cooler or one of the second intercooler and the aftercooler to the base frame, and a through bracket coupling a lower end of the other of the first intercooler and the oil cooler or the other of the second intercooler and the aftercooler, to the base frame to be vertically spaced apart from the base frame.

7. The air-cooling system for fluidic machine of claim 6, wherein a transfer pipe connected to the other of the first intercooler and the oil cooler or the other of the second intercooler and the aftercooler passes through the through bracket.

8. The air-cooling system for fluidic machine of claim 1, wherein the oil cooler is arranged above the first intercooler to be adjacent to an upper end of the first intercooler, the upper end being opposite to a lower end of the first intercooler which faces the base frame, and wherein the second intercooler and the aftercooler are successively stacked above the base frame to face the first intercooler and the oil cooler.

9. The air-cooling system for fluidic machine of claim 8, wherein the oil cooler arranged above the first intercooler has a size smaller than a size of the first intercooler, and wherein the second intercooler stacked above the aftercooler has a size smaller than a size of the aftercooler.

10. The air-cooling system for fluidic machine of claim 8, further comprising:

a bracket connecting each of a lower end of the first intercooler facing the base frame and a lower end of the second intercooler facing the base frame, to the base frame, and a connection bracket connecting the first intercooler to the oil cooler, and connecting the aftercooler to the second intercooler.

11. The air-cooling system for fluidic machine of claim 8, wherein the first intercooler and the oil cooler, and the aftercooler and the second intercooler are arranged inclined to the base frame to be spaced farther apart from each other toward an upper side above the base frame.

12. The air-cooling system for fluidic machine of claim 11, wherein an inclination angle at which the first intercooler and the oil cooler are inclined relative to the base frame is the same as an inclination angle at which the aftercooler and the second intercooler are inclined relative to the base frame.

13. The air-cooling system for fluidic machine of claim 1, further comprising an air/water separator connected to at least one of the first intercooler, the second intercooler, and the aftercooler, the air/water separator separating condensate included in compressed air.

14. The air-cooling system for fluidic machine of claim 1, further comprising a door arranged on a path which connects a cooling space to an outside, the cooling space formed by the first intercooler and the oil cooler, and the second intercooler and the aftercooler.

15. The air-cooling system for fluidic machine of claim 14, further comprising a partition surrounding the first intercooler, the oil cooler, the second intercooler, the aftercooler, and the cooling space, the partition comprising a blow hole in which the blower is provided, and an air circulation hole which connects the cooling space to the outside, wherein the door is rotatably coupled to the partition to open or close at least a part of the partition.

16. An air-cooling system for fluidic machine, the air-cooling system comprising:

a base frame extending in a first direction and a second direction, the first direction being perpendicular to the second direction;

a first intercooler arranged above the base frame in a third direction, the third direction being perpendicular to the second direction, wherein the first intercooler is configured for a fluid for heat exchange to flow therethrough;

an oil cooler arranged adjacent to the first intercooler, wherein the oil cooler is configured for oil to flow therethrough, and wherein the oil cooler is aligned with the first intercooler in the second direction;

a second intercooler arranged above the base frame in the third direction, wherein the second intercooler is configured for the fluid for heat exchange to flow therethrough, and wherein the second intercooler faces across from one of the first intercooler and the oil cooler in the first direction;

an aftercooler arranged adjacent to the second intercooler, wherein the second intercooler is configured for the fluid for heat exchange to flow therethrough, wherein the aftercooler faces across from the other of the first intercooler and the oil cooler in the first direction, and wherein the aftercooler is aligned with the second intercooler in the second direction; and a blower supplying cooling air to a space between where the first intercooler and the oil cooler are located, and where the second intercooler and the aftercooler are located.

17. The air-cooling system for fluidic machine of claim 16, wherein the oil cooler is arranged side-by-side next to one edge of the first intercooler successively in the second direction, and the aftercooler is arranged side-by-side next to one edge of the second intercooler in the second direction.

18. The air-cooling system for fluidic machine of claim 16, wherein the oil cooler is arranged above the first intercooler in the third direction to be adjacent to an upper end of the first intercooler, the upper end being opposite to a lower end of the first intercooler which faces the base frame, and the second intercooler and the aftercooler are successively stacked above the base frame to face the first intercooler and the oil cooler.

19. The air-cooling system for fluidic machine of claim 17, wherein the first intercooler together with the oil cooler, and the aftercooler together with the second intercooler, are arranged inclined relative to the base frame to be spaced farther apart from each other in the third direction as distance away from the base frame increases.

20. The air-cooling system for fluidic machine of claim 16, further comprising a partition surrounding the first intercooler, the oil cooler, the second intercooler, the aftercooler, and the space, the partition comprising a blow hole in which the blower is provided and an air circulation hole that connects the space to an outside.

* * * * *